United States Patent [19]

Bartholomäeus

[11] 3,983,908

[45] Oct. 5, 1976

[54] SERVO VALVE REGULATING ARRANGEMENT

[75] Inventor: Reiner Bartholomäeus, Lohr (Main), Germany

[73] Assignee: Indramat-Gesellschaft fur Industrie-Rationalisierung und Automatisierung, Lohr (Main), Germany

[22] Filed: Oct. 10, 1972

[21] Appl. No.: 296,173

[30] Foreign Application Priority Data

Oct. 12, 1971 Germany ..... 2150755

[52] U.S. Cl. ..... 137/625.62

[51] Int. Cl.[2] ..... F15B 13/043

[58] Field of Search..... 137/85, 625.62, 625.63, 137/625.66

[56] References Cited

UNITED STATES PATENTS

| | | | |
|---|---|---|---|
| 2,954,794 | 10/1960 | Paine | 137/85 X |
| 2,964,059 | 12/1960 | Geyer | 137/625.62 |
| 3,405,735 | 10/1968 | Adams | 137/625.69 |
| 3,486,801 | 12/1969 | Frayer | 137/625.62 X |
| 3,680,596 | 8/1972 | Pickett | 137/625.69 |

*Primary Examiner*—Alan Cohan
*Assistant Examiner*—Gerald A. Michalsky
*Attorney, Agent, or Firm*—Michael J. Striker

[57] ABSTRACT

A control valve has a stepped cylinder and piston having at one end a small diameter end face forming an end chamber, and also a large diameter annular face forming an annular chamber at the end. The other end of the piston has a large diameter end face forming a large diameter chamber. A high pressure pump conduit, a low pressure discharge conduit and a variable pressure consumer conduit have cylinder ports cooperating with the stepped piston, and the consumer conduit has a branch conduit opening in the annular chamber. The piston is movable between the neutral position closing the conduits and two operative positions for connecting the pump conduit with the consumer conduit or with the discharge conduit. A fluidic amplifier has an inlet connected with the pump conduit and two outlets, one of the outlets opening in the small diameter end chamber so that the consumer conduit pressure and the pressure of this outlet together act on the piston in one direction, and the other outlet opening in the large diameter pressure chamber so that the pressure of the other outlet acts on the piston in the opposite direction. The fluidic amplifier is shiftable between a neutral position in which the pressure at the outlets are equal, and two control positions in which the pressures at said outlets are different. When the fluidic amplifier is placed in one of the control positions by an electromagnet, the piston is displaced to one of the operative positions thereof until equilibrium between the pressure forces acting in opposite directions at the ends of the piston is obtained at a desirable pressure in the consumer conduit.

6 Claims, 1 Drawing Figure

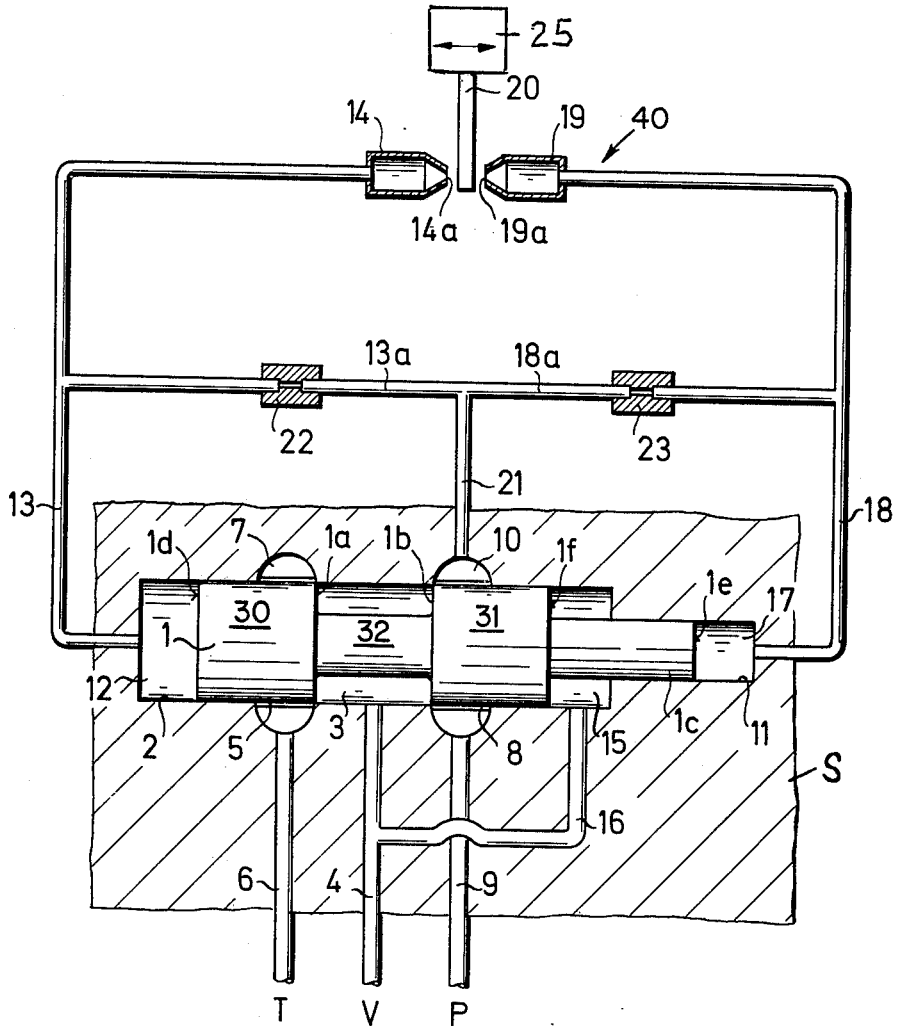
25
20
14
19
40
14a
19a
13a
18a
22
23
21
13
18
1d
7
1a
1b
10
1f
1e
17
30
32
31
1
12
2
5
3
8
15
1c
11
S
16
6
4
9
T
V
P

SERVO VALVE REGULATING ARRANGEMENT

BACKGROUND OF THE INVENTION

The present invention relates to a three way servo valve whose piston is displaced by a symmetrical fluidic amplifier, and which is at one end also subjected to the pressure of a consumer conduit.

In a servo control valve of this type according to the prior art, the pump pressure acts at one end, and the consumer conduit pressure acts on the other end of the piston. The pressure of the consumer conduit is applied to a portion of the respective end face of the piston. The piston is in equilibrium when the opposing axial forces are equal. In this position of equilibrium, the piston is in an initial position, and the consumer conduit is separated from the pump conduit, and from the discharge conduit. When the control pressure produced by a fluidic amplifier is reduced, the respective obtained consumer pressure is increased, and vice versa. In the valve according to the prior art, the end face to which the pump conduit pressure is applied has the same area as the end face to which the consumer conduit pressure is applied, and difficulties arise when the consumer pressure is to be equal to the pump pressure. In this event, the control pressure must be zero which can be obtained only by stopping the flow of control fluid through the fluidic amplifier, which requires a very expensive construction.

SUMMARY OF THE INVENTION

It is an object of the invention to overcome the disadvantages of the prior art servo control valves, and to provide a servo valve arrangement using a fluidic amplifier which uses the entire regulating range of the fluidic amplifier and obtains any pressure in the consumer conduit between the value zero and the pump pressure.

Another object of the invention is to provide a sevo valve regulating arrangement of simple construction which is capable of varying the pressure in a consumer conduit within a wide range.

With these objects in view, the piston of the control valve is subjected at both ends by pressures produced by a fluidic amplifier. When the fluidic amplifier is not in its neutral position, the pressures are different, and the respective end faces of the piston on which the pressures of the amplifier act, have different effective surfaces. The smaller effective surface is at the end of the control piston which is also subjected to pressure from the consumer conduit. Due to the fact that one end face of the piston is not directly subjected to the high pump pressure of the pump conduit, but to the control pressure produced by a fluidic amplifier, the pressure of the consumer conduit can be exactly determined due to the pressure difference produced by the fluidic amplifier on the control piston on which also the consumer pressure acts. This is particularly the case for the pressure zero, and for a maximum pressure in the consumer conduit which corresponds to the pump pressure. Another advantage of the invention resides in that a variation of the pump pressure can only partly influence the consumer conduit pressure. Three way servo valves are known whose control piston is also operated by the differential pressure produced by fluidic amplifier. This pressure differential cooperates, however, with a regulating spring acting on the control piston for moving the same to an open position. The use of a regulating spring has the disadvantage that the selected consumer pressure depends substantially on the magnitude of the flow of working fluid. In the region of the flow reversal of the working fluid, a sudden change of the selected and set consumer pressure occurs.

In a control piston exclusively controlled by the consumer pressure and by the pressure differential of the fluidic amplifier, the dependency of the set pressure from the magnitude of the flow of working fluid is negligible. Furthermore, even a substantial overlapping of the control edge of the control piston with their respective port, does not influence the characteristics of the apparatus. Therefore, the amount of control fluid is very small.

In the preferred embodiment of the invention, the pump conduit and the discharge conduit open, respectively, in one or several cutout ports in the cylinder surface which act as control openings for the control piston. As compared with an annular opening, the advantage results that a longer stroke of the control piston is required for a particular amount of working fluid. This has a favorable influence on a stable pressure selection. For manufacturing reasons, it may be advantageous to provide the cutouts not in the cylinder surface, but in the piston surface, so that the cutouts cooperate with a circular control edge in the cylinder bore in which the control piston moves.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

The single FIGURE of the drawing is a schematic and diagrammatic view, partially in section, illustrating an embodiment of the invention.

DESCRIPTION OF THE PREFERRED EMBODIMENTS

A stepped piston 1 is guided for axial movement in a stepped cylinder bore 2 located in a supporting body S and having a small diameter cylinder end portion 11. Piston 1 has two large diameter piston portions 30 and 31, and a small diameter portion 1c projecting into the cylinder portion 11. The connecting portion 32 between the large diameter piston portions 30 and 31, forms an annular connecting space 3 in the cylinder bore 2. The small diameter end face 1e forms a smaller diameter end chamber 17 at one end of the piston. The large diameter end face 1d of piston portion 30 forms a large diameter end chamber 12 at the other end of the cylinder. The annular face 1f of the piston portion 31 which surrounds the small diameter piston portion 1c forms the annular chamber 15.

In the schematically shown supporting body S of the valve, three conduits 6, 4 and 9 are provided. Conduit 6 is a discharge conduit which is connected with a collecting container, not shown, represented by T, for fluid and liquid. Conduit 4 is a consumer conduit connected to a hydraulic consumer apparatus, not shown, represented by V. and conduit 9 is a high pressure pump conduit connected with the outlet of a pump, not shown, represented by P. In the illustrated closed position of the valve 1, 2, a port of consumer conduit 4 opens in the cylinder 2 in the region of the annular connecting chamber 3. A branch conduit 16 of a consumer conduit 4 opens in a port in the annular chamber 15.

The pump conduit 9 forms an annular chamber 10 around the cylinder bore 2, and opens into the cylinder through cutout ports 8 which cooperate with a circular control edge 1b on the piston portion 31.

The discharge conduit 6 opens into an annular chamber 7 surrounding piston portion 1 in the illustrated closed position of the valve, and communicating with the cylinder bore through cutout ports 5 cooperating with the circular control edge 1a of piston portion 30.

In the illustrated position, the consumer apparatus V is separated from the discharge container T and from the pump P.

A fluidic amplifier 40 controls the movements of the piston 1, and has an inlet conduit connected with the annulr space 10 of pump conduit 9, and two outlets 13 and 18. Outlet 18 is connected with small diameter end chamber 11 at one end of piston 1, and outlet 13 is connected with the large diameter end chamber 12 at the other end of piston 1. Outlet conduit 13 is connected with a jet nozzle 14, and outlet conduit 18 is connected with a jet nozzle 19. The inlet 21 is connected to conduits 13a and 18a which contain, respectively, flaired throttling nozzles 22 and 23 which are also connected with outlet conduits 13 and 18 and with the jet nozzles 14 and 19 which eject fluid from opposite sides against an angularly displaceable baffle plate 20 which is controlled by an electromagnet 25 in a manner which is well known, and not an object of the invention. By operation of the electromagnet, the movable baffle plate can be moved out of neutral position equally spaced from the nozzle openings 14*a* and 19*a*, to control positions in which the distance between the baffle plate and the nozzle openings 14*a* and 19*a* are different, resulting in different pressures in the outlets 13 and 18. In the neutral position of the baffle plate 20, the pressures in outlet conduits 13 and 18 are equal, and half of the pressure in the inlet conduit 21, which corresponds to the pump pressure in the pump conduit 9, 10. Accordingly, in a neutral position of the fluidic amplifier 40, the pressures in the end chambers 17 and 12 are equal, and half of the pressure prevailing in the pump conduit 9.

When the baffle plate is in the illustrated neutral position equally spaced from the nozzle openings 14*a* and 19*a*, the annular throttling cross-sections between the baffle plate 20 and the nozzle openings 14*a* and 19*a* are equal to the throttling cross sections of the stationary throttles 22 and 23 so that half the pump pressure prevails in end chambers 12 and 17, as explained above.

The effective end face 1*d* of piston portion 30 is greater than the effective end face 1*e* of piston portion 1*c*, so that piston 1 is moved in axial direction to the right as viewed in the drawing to a position in which the control edge 1*b* of the piston portion 31 opens the cutout ports 8 of pump conduit 9, so that the same is connected with the consumer conduit 4 by the annular space 3, and the pressure in consumer conduit 4 rises.

When the pressure in consumer conduit 4 corresponds to half the pressure of the pump conduit 9, the pressure of the consumer conduit acts through branch conduit 16 and annular chamber 15 on the annular face 1*f* of piston portion 31 so that the difference between the areas of the effective surfaces 1*d* and 1*e*, is compensated, and piston 1 stops in a position of equilibrium.

A further increase of the pressure in the consumer conduit 4, 16 would cause an immediate closing of the pump conduit 9 by piston portion 31, and by further movement to the left even a connection between the discharge conduit 6, 7 and the consumer conduit 4 causing an immediate reduction of the pressure in the consumer conduit 4.

If the electromagnet 25 is now operated to an angularly displace the baffle plate 20, for example toward the jet nozzle 19, the pressure in outlet conduit 18 increases, and the pressure in outlet conduit 13 decreases the same amount. This results in different axial forces acting on the end faces 1*e* and 1*d* which moves to the left reducing the volume of the end chamber 12. Due to this movement of piston 1, consumer conduit 4 is connected with the discharge conduit 6 through the cutout ports 5, so that the pressure in consumer conduit 4 is reduced, resulting in reduction of the pressure in the branch conduit 16 and in the annular chamber 15 so that a smaller pressure acts on the annular face 1*f* of piston 1. When the pressure in consumer conduit 4 has dropped further to such a level that the sum of the product of the annular face 1*f* multiplied by the consumer pressure in consumer conduits 4, 16, and of the product of the end face 1*e* multiplied by the pressure in outlet conduit 18 is equal to the product of the end face 1*d* and the pressure in the outlet conduit 13, the control piston 1 is again stopped in a position of equilibrium, and causes, if the consumer pressure in consumer ports 4 and 16 further drops, the closing of ports 5 of discharge conduit 6 by the control edge 1*a* of piston portion 30 so that no discharge can take place from the consumer conduit 4 into the discharge conduit 6. In this manner, piston 1 has been placed in an adjusted position in which the desired consumer pressure prevails in the consumer conduit 4, under the control of the fluidic amplifier 40, and more particularly under the control of the set baffle plate 20.

If the baffle plate 20 is angularly displaced in the opposite direction than before toward the jet nozzle 14, the pressure in the outlet conduit 13 rises, while the pressure in the outlet conduit 18 is reduced to the same extent. Consequently, a pressure differential acts in end chambers 17 and 12 in this control position of baffle plate 20, which is opposite to the pressure differential obtained in the first above-described control position of baffle plate 20. The piston is urged to the right as viewed in the drawing to reduce the volume of end chamber 17 so that the consumer conduit 4 is connected with the pump conduit 9. In this manner, a pressure increase is caused in the consumer conduit 4, which is applied through branch conduit 16 in the annular chamber 15 to act on the annular face 1*f*.

When the pressure in consumer conduits 4, 16 has risen so high that the piston 1 is again in equilibrium due to the high axial pressure force produced by the annular force 1*f*, further increase in the consumer conduit 4 causes displacement of piston 1 to the left to reduce the volume of chamber 12 so that in the illustrated position, the pump conduit 9 is closed and separated from the consumer conduit 4, so that the pressure cannot rise in the consumer conduit 4.

Due to the face that working fluid applied under pressure through pump conduit 9 flows through the cutout ports 8 from the annular chamber 10 into the connecting chamber 3, and through the ports 5 into annular chamber 7 and discharge conduit 6, only small fluid pressures act on piston 1, so that the regulating pressure of outlet conduits 13, 18 does not substantially depend on the volume of fluid flowing through the valve 1, 2. The smaller the free cross-section of the cutout ports 5 and 8 is in relation to a predetermined stroke of piston 1, the greater must be the stroke of the piston 1 in order to permit the passage of a predetermined amount of working fluid, and the smaller are the forces applied by the flowing working fluid to the control piston.

It should be noted that the ratio between the annular face 1*f* and the end face 1*e* can be adapted to prevailing conditions, particularly to the output of the fluidic amplifier 25 without influencing the operation of the control valve 1, 2. The greater the diameter of the end face 1*e* is selected, the smaller must be the annular face 1*f*, so that the consumer pressure acting on the annular face 1*f*, has only little influence on the regulation. In this case, a low pressure differential between outlet conduits 13, 18 of the fluidic amplifier 40 can be used for regulating the consumer pressure from a minimum to a maximum. If the range of regulation of the fluidic amplifier is fully used, and a small pressure differential maximum is required, the amplification factor of the fluidic amplification can be increased in accordance with the input signal acting on the baffle plate 20.

In a modification of the invention, the outlet conduit 18 is not connected with the end chamber 17, but with the annular chamber 15, and the branch conduit 16 of the consumer conduit 14 is not connected with the annular chamber 15, but with the end chamber 17. When the pressures on end face 1*e* with annular face 1*f* are added, the different connection has no effect on the operation.

It will be understood that each of the elements described above, or two or more together, may also find a useful application in other types of servo valve regulating arrangements differing from the types described above.

While the invention has been illustrated and described as embodied in a control valve having a control piston whose movement is influenced by the differential pressure produced by a fluidic amplifier, and by the pressure in the consumer conduit, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention and, therefore, such adaptations should and are intended to be comprehended withing the meaning and range of equivalence of the following claims.

I claim:

1. Servo valve regulating arrangement, comprising control valve means including a stepped cylinder, and an integral stepped piston movable in said stepped cylinder and having at one end a small diameter end face forming a small diameter end chamber in said cylinder, and also a large diameter annular face forming an annular chamber in said cylinder, said piston having at the other end thereof a large diameter end face forming at said other end a large diameter chamber in said cylinder having an effective surface greater than the effective surface of each of said chambers at said one end of said piston; conduit means including a high pressure pump conduit, a low pressure discharge conduit, and a variable pressure consumer conduit, said conduits having ports opening in said cylinder and cooperating with said piston, and said consumer conduit having a branch conduit opening in said annular chamber at said one end of said piston; said piston being movable between a neutral position closing said conduits, and two operative positions for connecting said consumer conduit with said pump conduit and said discharge conduit, respectively; and a fluidic amplifier having an inlet connected with said pump conduit and two outlets, one of said outlets opening in said small diameter chamber of said two chambers at said one end of said piston so that the consumer conduit pressure and the pressure of said one outlet together act on said piston in one direction, and the other outlet opening in said large diameter pressure chamber so that the pressure of said piston in a direction opposite to said one directon, said fluidic amplifier including a movable part having a neutral position in which the pressures at said outlets are equal, and two control positions in which said pressures at said outlets are different so that when said part of said fluidic amplifier is placed in said control positions, said piston is displaced to one of said operative position until equilibrium between the pressure forces acting in opposite directions at said ends of said piston is obtained at a desired pressure in said consumer conduit.

2. Servo valve regulating arrangement as claimed in claim 1, wherein said piston includes two piston portions of large diameter, an intermediate piston portion of small diameter forming an annular connecting chamber in said cylinder, and a small diameter piston end portion having said small diameter end face, and centrally projecting from one of said large diameter piston portions whereby said large diameter annular face is formed on said one piston portion around said piston end portion.

3. Servo valve regulating arrangement as claimed in claim 2, wherein said large diameter piston portions have annular control edges on opposite sides of said annular connecting chamber, respectively; wherein said pump conduit and said discharge conduit have ports cooperating with said control edges of said large diameter piston portions, respectively; and wherein said port of said consumer conduit opens in said annular connecting chamber so that said port of said pump conduit is connected by said annular connecting chamber with said port of said consumer conduit in one of said operative positions of said piston, and so that said port of said discharge conduit is connected by said annular connecting chamber with said port of said consumer conduit in the other operative position of said piston.

4. Servo valve regulating arrangement as claimed in claim 3, wherein said cylinder has an inner cylindrical surface, and wherein said large diameter piston portions form an outer cylindrical surface of said piston slidingly engaging said inner cylindrical surface, one of said cylindrical surfaces being formed with cutouts communicating with said ports of said pump conduit and of said discharge conduit and cooperating with said control edges.

5. Servo valve arrangement as claimed in claim 4, wherein said cutouts are formed in said inner cylindrical surface of said cylinder.

6. Servo valve regulating arrangement as claimed in claim 1 wherein the sum of the products of said small diameter end face and of said large diameter annular face at said one end of said piston multiplied by the pressures acting thereon, respectively, is a smaller force than the product of said large diameter face at the other end of said piston multiplied by the pressure acting thereon when said piston and said fluidic amplifier are in said neutral positions and the consumer pressure is zero so that said piston moves in one direction out of said neutral position for connecting said pump conduit with said consumer conduit.

* * * * *